US010619384B2

(12) United States Patent
Im et al.

(10) Patent No.: US 10,619,384 B2
(45) Date of Patent: Apr. 14, 2020

(54) TRUNK LATCH MODULE FOR VEHICLE

(71) Applicants: Hyundai Motor Company, Seoul (KR); PYEONG HWA AUTOMOTIVE CO., LTD, Daegu (KR)

(72) Inventors: Yong Hyuck Im, Seoul (KR); Chang Soo Kim, Gyeonggi-do (KR)

(73) Assignees: Hyundai Motor Company, Seoul (KR); Pyeong HWA Automotive Co., Ltd., Daegu (KR)

( * ) Notice: Subject to any disclaimer, the term of this patent is extended or adjusted under 35 U.S.C. 154(b) by 622 days.

(21) Appl. No.: 15/338,896

(22) Filed: Oct. 31, 2016

(65) Prior Publication Data

US 2017/0328092 A1 Nov. 16, 2017

(30) Foreign Application Priority Data

May 11, 2016 (KR) ..... 10-2016-0057546

(51) Int. Cl.

| | |
|---|---|
| ***E05B 81/16*** | (2014.01) |
| ***E05B 81/20*** | (2014.01) |
| ***E05B 81/34*** | (2014.01) |
| ***E05B 81/64*** | (2014.01) |
| ***E05B 83/18*** | (2014.01) |

(52) U.S. Cl.

CPC ..... *E05B 81/20* (2013.01); *E05B 81/16* (2013.01); *E05B 81/34* (2013.01); *E05B 81/64* (2013.01); *E05B 83/18* (2013.01)

(58) Field of Classification Search

CPC ..... E05B 81/20; E05B 83/18; E05B 81/64; E05B 81/16; E05B 81/34

USPC ..... 292/201, 216, DIG. 23

See application file for complete search history.

(56) References Cited

U.S. PATENT DOCUMENTS

| | | | | |
|---|---|---|---|---|
| 7,341,290 | B2 * | 3/2008 | Torka | E05B 81/20 292/201 |
| 8,388,030 | B2 * | 3/2013 | Takahashi | E05B 81/16 292/201 |
| 2006/0284425 | A1 | 12/2006 | Torka et al. | |
| 2007/0220934 | A1 | 9/2007 | Chevalier | |

FOREIGN PATENT DOCUMENTS

| | | | |
|---|---|---|---|
| JP | 2008-013932 | A | 1/2008 |
| JP | 2009-249836 | A | 10/2009 |
| KR | 2008-0061625 | A | 7/2008 |
| KR | 10-1220394 | B1 | 1/2013 |
| KR | 10-2016-0041189 | A | 4/2016 |
| KR | 15338896 | B1 | 4/2016 |

* cited by examiner

*Primary Examiner* — Kristina R Fulton
*Assistant Examiner* — Thomas L Neubauer
(74) *Attorney, Agent, or Firm* — Mintz Levin Cohn Ferris Glovsky and Popeo, P.C.; Peter F. Corless

(57) ABSTRACT

Disclosed is a trunk latch for a vehicle includes a base plate, a first locking groove in which a striker is inserted, a main gear supplied with power through a motor, a claw including a latch protrusion at an outer circumferential surface thereof, a link assembly moving in a linked manner in accordance with rotation of the main gear to transfer power to the claw, and a claw locking assembly supplied with power from the link assembly to fix or unfix movement of the claw.

8 Claims, 9 Drawing Sheets

TRUNK LATCH MODULE FOR VEHICLE

CROSS-REFERENCE TO RELATED APPLICATION

This application claims under 35 U.S.C. § 119(a) the benefit of Korean Patent Application No. 10-2016-0057546, filed on May 11, 2016 in the Korean Intellectual Property Office, the entire contents of which are incorporated by reference herein.

BACKGROUND

1. Technical Field

The present invention relates to a trunk latch module for a vehicle capable of controlling a locked or unlocked state of a trunk using one motor.

2. Description of the Related Art

Generally, a vehicle is provided with a trunk door for loading or unloading objects, doors for people to enter or exit, and a hood for opening or closing an engine room. In this case, each door or the hood includes a striker and a door latch for locking or unlocking the respective door or hood.

In a trunk latch mounted to open or close the trunk, when the trunk is not completely closed due to insufficient force, a driver recognizes that the trunk is opened through a signal displayed on a dashboard after getting into a driver's seat. In this case, it is inconvenient for the driver to leave the driver's seat and move to the trunk again in order to check whether the trunk is opened or closed. To this end, a power trunk latch has been developed. The power trunk latch may allow the trunk to be completely locked through motors.

However, in a typical power trunk latch, there are two motors for locking and unlocking the trunk, which transfer power in separate directions, and thus a volume of a power trunk latch module is dramatically increased as compared to a vehicle without the power trunk latch. Accordingly, it is difficult to mount the power trunk latch in the vehicle.

The matters disclosed in this section are merely for enhancement of understanding of the general background of the invention and should not be taken as an acknowledgment or any form of suggestion that the matters form the related art already known to a person skilled in the art.

SUMMARY

Therefore, it is an object of the present invention to provide a trunk latch module for a vehicle capable of locking and unlocking a trunk latch using one motor and providing an emergency open function.

In accordance with one aspect of the present invention, the above and other objects can be accomplished by the provision of a trunk latch module for a vehicle including a base plate; a first locking groove, into which a striker is inserted, the first locking groove having a depressed shape from a lower end of the base plate toward a central part of the base plate; a main gear disposed above the first locking groove, rotatably coupled to the base plate, and supplied with power through a motor; a claw, a central part of which is rotatably coupled to the base plate at one side of the first locking groove, wherein one end of the claw includes a second locking groove having a depressed shape toward the central part thereof and facing an entrance position of the striker, and another end of the claw includes a latch protrusion at an outer circumferential surface thereof; a link assembly coupled to the main gear and configured to move in a linked manner in accordance with rotation of the main gear, to transfer power to the claw; and a claw locking assembly supplied with power from the link assembly to fix or unfix movement of the claw, wherein as the main gear rotates in one direction by the motor, the link assembly and the claw locking assembly engage with the latch protrusion of the claw so as to lock the claw, and as the main gear rotates in an opposite direction, the link assembly and the claw locking assembly are separated from the latch protrusion of the claw so as to unlock the claw.

The motor and main gear may be coupled using a worm and a worm gear to transfer power.

The latch protrusion of the claw may include a first latch protrusion, a second latch protrusion, and a third latch protrusion.

The link assembly may include a first link, a first end of which may be fixed to the main gear and move in a linked manner in accordance with the main gear, and a central part of which may include a slit groove, a second link, a first end of which may coupled to a second end of the first link in a hinged manner, and a central part of which may include a protrusion, and a third link, a first end of which may be coupled to the slit groove formed at the central part of the first link to be movable along the slit groove, and a second end of which may be coupled to a second end of the second link in a hinged manner.

The locking assembly may include a cancel lever, one end of which may be rotatably coupled to one side of the first locking groove, and which may include an extending part protruding from a central part thereof to the first locking groove, and a pawl lever, one end of which may be coaxially coupled to the cancel lever to be rotatable, and which may move in a linked manner in accordance with the cancel lever.

When the main gear rotates counterclockwise, the first link may be rotated thereby, the protrusion of the second link downwardly may press the extending part of the cancel lever such that the cancel lever may rotate clockwise, the pawl lever moving in linkage with the cancel lever may press the first latch protrusion of the claw such that the claw may rotate clockwise until the claw reaches a hinge coupler between the second and third links, the hinge coupler between the second and third links may press the first latch protrusion such that the claw may rotate clockwise until the pawl lever engages with the second latch lever so as to perform a first locking.

The hinge coupler between the second and third links may press the first latch protrusion such that the claw may rotate clockwise until pawl lever engages with the third latch protrusion so as to perform a second locking.

When the main gear rotates clockwise, the cancel lever may rotate counterclockwise by a hinge coupler between the first and second links, the pawl lever may rotate counterclockwise in a linked manner in accordance with the cancel lever, the pawl lever may be separated from the third latch protrusion to be released so as to perform unlocking.

The trunk latch module may further include a controller, wherein the controller may detect a first locking state through a first sensor attached to the cancel lever, may control counterclockwise rotation of the main gear by controlling motor operation, may detect completion of second locking through a second sensor provided adjacent to the claw on the base plate, may control clockwise rotation of the main gear through a third sensor disposed on the main gear, and may control the hinge coupler between the second and third links to be disposed at the second latch protrusion of the claw.

Another end of the cancel lever may be supplied with force to rotate counterclockwise so as to perform an emergency open function.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles. The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, the present invention will be described in detail with reference to the accompanying drawings to allow those skilled in the art to easily practice the present invention.

Figure 1:
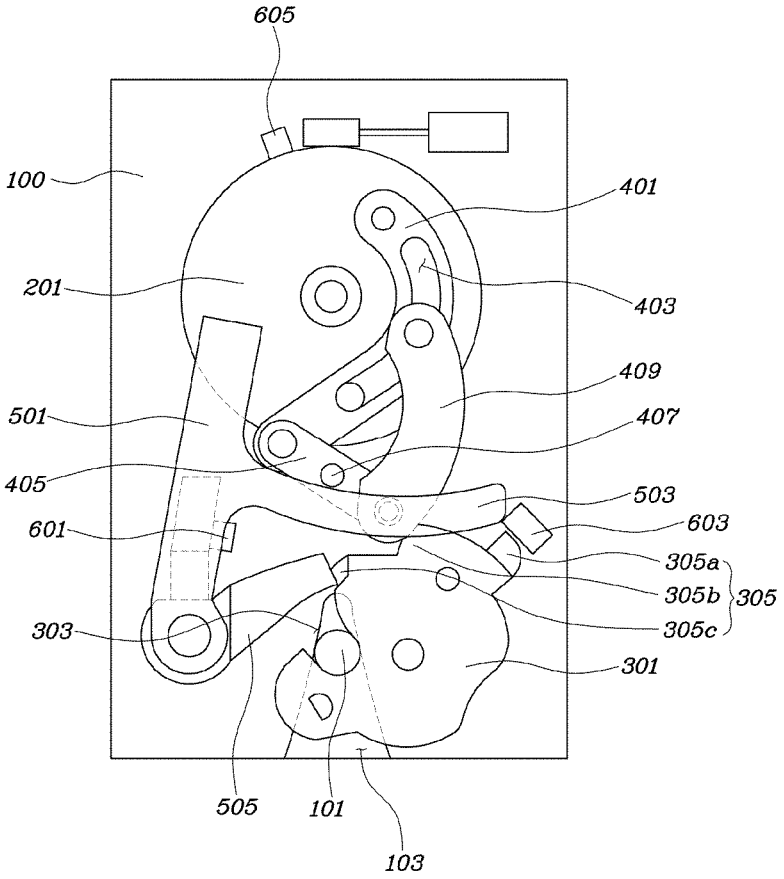
FIG. 1 is a view illustrating a trunk latch module for a vehicle according to an embodiment of the present invention.
Figure 2A:
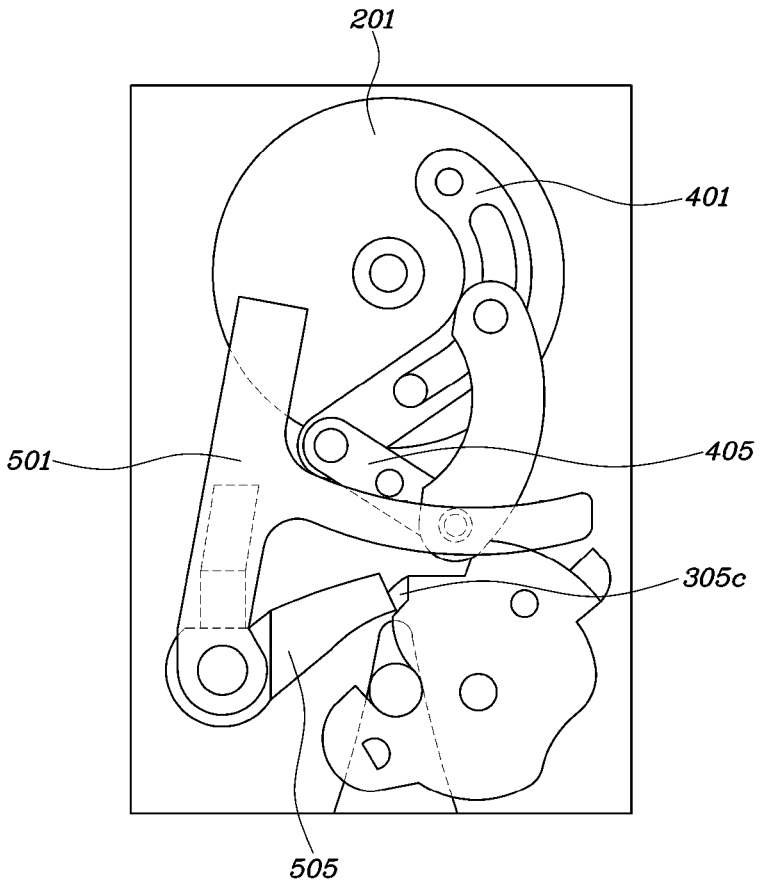
FIGS. 2A to 2C are views illustrating an unlocked state of the trunk latch module for the vehicle according to the present invention.
Figure 2B:
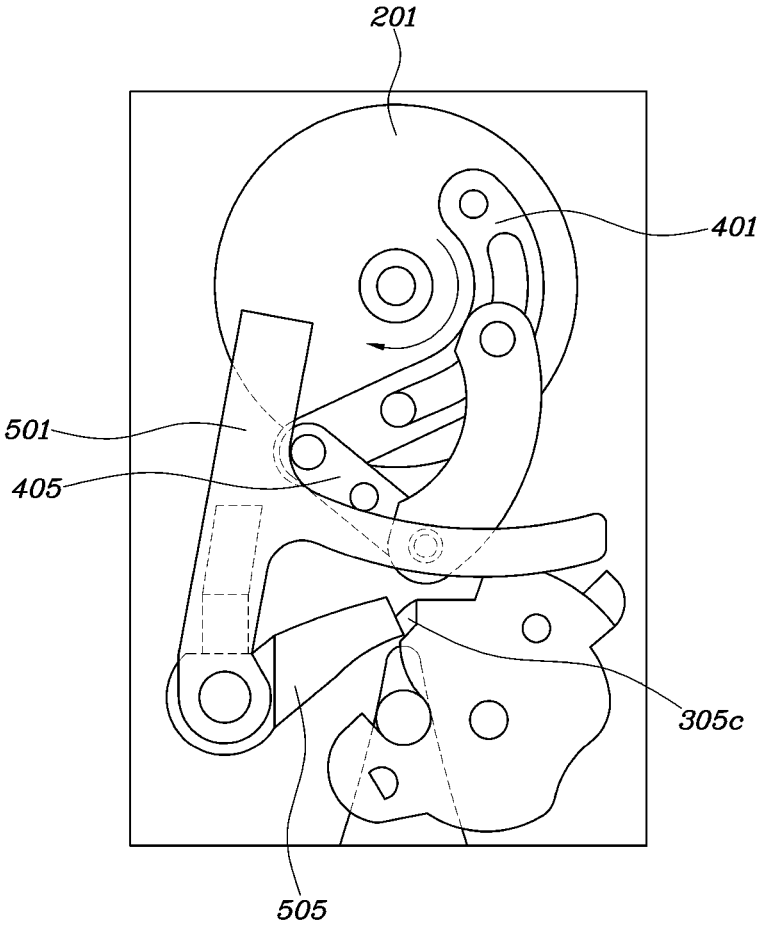
Figure 2C:
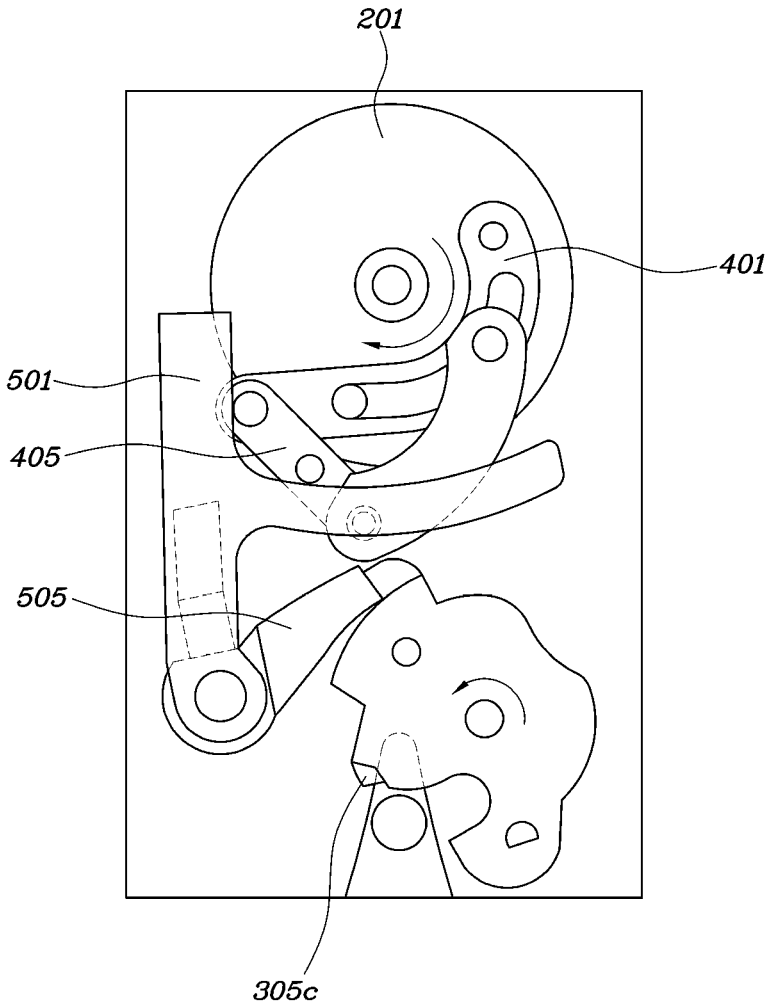
Figure 3A:
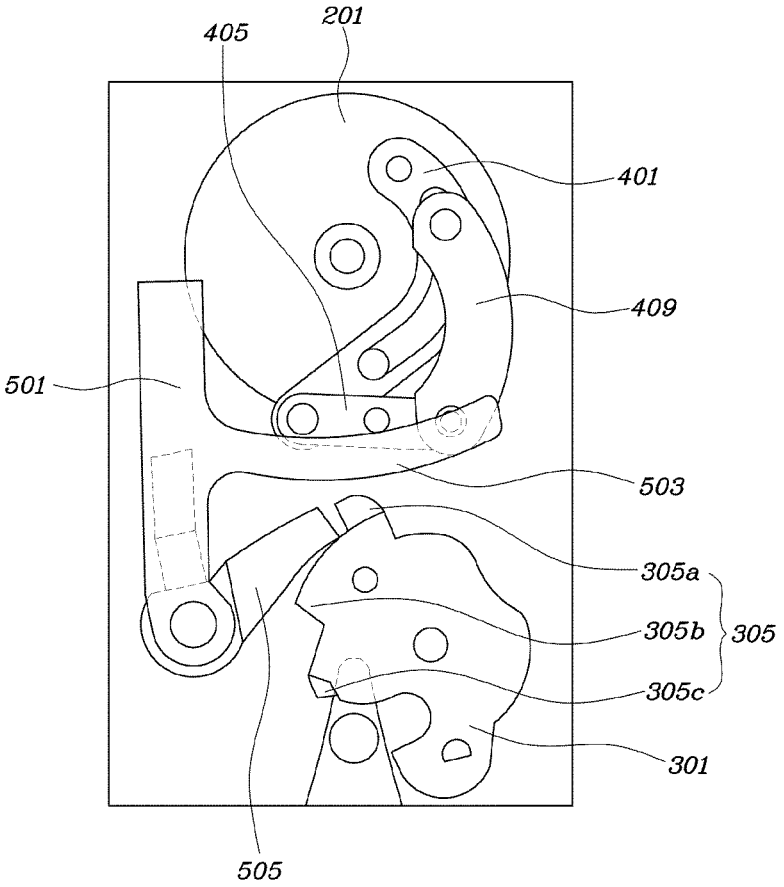
FIGS. 3A to 3C are views illustrating a locked state of the trunk latch module for the vehicle according to the present invention.
Figure 3B:
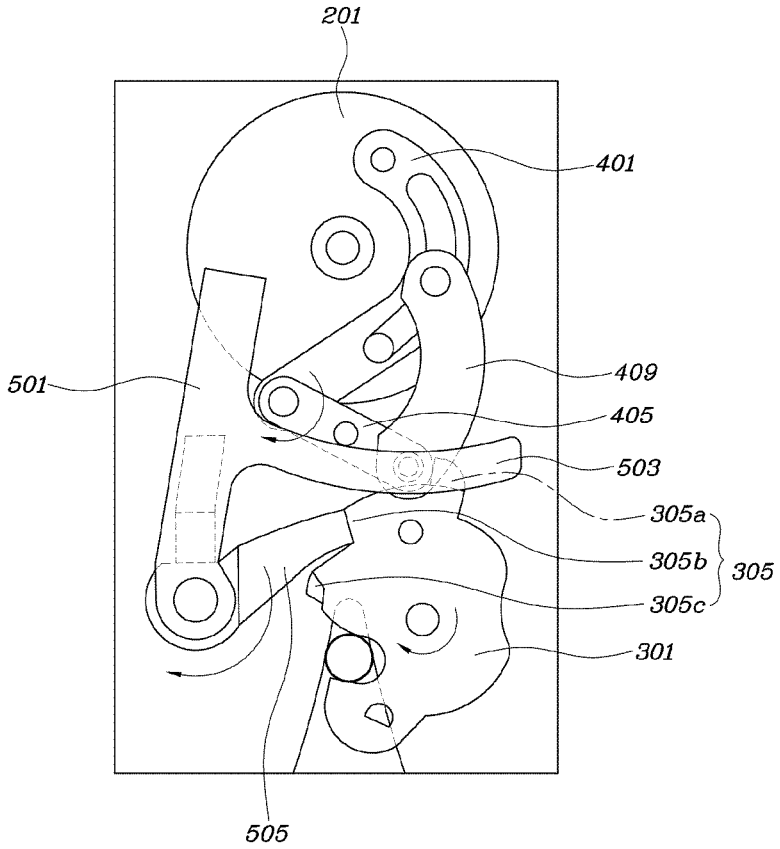
Figure 3C:
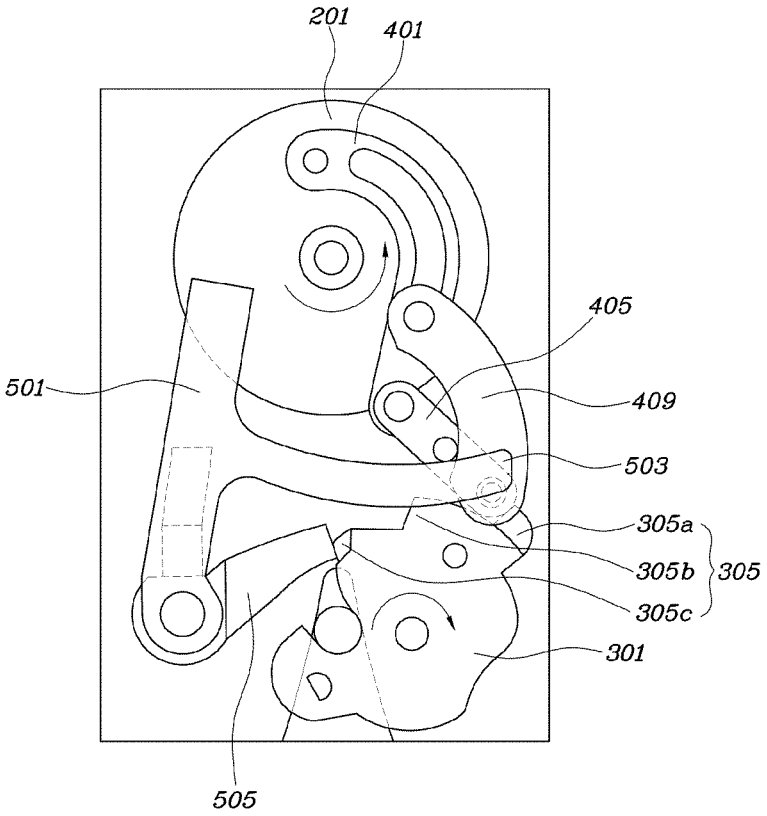

FIG. 1 is a view illustrating a trunk latch module for a vehicle according to an embodiment of the present invention. FIGS. 2A to 2C are views illustrating an unlocked state of the trunk latch module for the vehicle according to the present invention. FIGS. 3A to 3C are views illustrating a locked state of the trunk latch module for the vehicle according to the present invention.

In accordance with the present invention, the trunk latch module for the vehicle includes a base plate 100, a first locking groove 103, a main gear 201, a claw 301, a link assembly 400, and a claw locking assembly 500. The first locking groove 103, into which a striker 101 is capable of being inserted, is formed to have a depressed shape from a lower end of the main plate 100 toward a central part of the main plate 100. The main gear 201 is disposed above the first locking groove 103, is rotatably coupled to the main plate 100, and is supplied with power through a motor. A central part of the claw 301 is disposed at one side of a center of the first locking groove 103 and is rotatably coupled to the main plate 100. A second locking groove 303 is formed to have a depressed shape toward the central part of the claw 301 at one end of the claw 301, and to face an entrance position of the striker 101. A latch protrusion 305 is formed at an outer circumferential surface of another end of the claw 301. The link assembly 400 is coupled to the main gear 201, moves in a linked manner in accordance with rotation of the main gear 201, and thus transfers power to the claw 301. The claw locking assembly 500 is supplied with power from the link assembly 400, and thus fixes or unfixes movement of the claw 301. When the main gear 201 rotates in one direction by the motor, the link assembly 400 and claw locking assembly 500 engage with the latch protrusion 305 of the claw 301, and thus the claw 301 is locked. When the main gear 201 rotates in the other direction, the link assembly 400 and claw locking assembly 500 are separated from the latch protrusion 305 of the claw 301, and thus the claw 301 is unlocked. The motor and main gear 201 are coupled using a worm and a worm gear, thereby transferring power.

Referring to FIG. 1, the trunk latch module according to the present invention includes the main gear 201 for reinforcing motor power through the worm and worm gear, the link assembly 400 for converting constant rotational motion of the main gear 201 into linear motion or another rotational motion, the claw 301 for locking the striker 101, and the claw locking assembly 500 for fixing the claw 301 in a locked state.

Hereinafter, details of trunk latch module will be described.

The latch protrusion 305 of the claw 301 may include a first latch protrusion 305*a*, a second latch protrusion 305*b*, and a third latch protrusion 305*c*.

Referring to FIG. 1, the first latch protrusion 305*a* functions to rotate the claw 301 until the claw 301 reaches a final position for secondary locking. The second latch protrusion 305*b* functions to fix the striker 101 in a primary locked state. The third latch protrusion 305*c* functions to fix the striker 101 in a secondary locked state.

The link assembly 400 may include a first link 401, a first end of which is fixed at the main gear 201 and moves in a linked manner in accordance with the main gear 201 and a central part of which has a slit groove 403, a second link 405, a first end of which is coupled to a second end of the first link 401 in a hinged manner and a central part of which includes a protrusion 407, and a third link 409, a first end of which is coupled to the slit groove 403 formed at the central part of the first link 401 to be movable along the slit groove 403 and a second end of which is coupled to a second end of the second link 405 in a hinged manner.

The first link 401 is fixedly coupled to the main gear 201, and thus the first link rotates in accordance with rotation of the main gear 201. A part from a first end to the central part of the first link 401 has a curved shape along an outer circumferential surface of the main gear 201. A part from the central part to the second end of the first link 401 has a linear shape. The slit groove 403 is formed at the central part of the first link 401 to provide a moving path of the first end of the third link 409. The first end of the second link 405 is coupled to the second end of the first link 401 in a hinged manner to be rotatable. The second end of the second link 405 is coupled to the second end of the third link 409. The protrusion 407 is formed at the central part of the second link 405, and thus the protrusion 407 functions to transfer rotational force to a cancel lever 501 in sequential rotation process of the link assembly 400. The first end of the third link 409 is movable along the slit groove 403 of the first link and, thus a center of rotation diversely changes. At the same time, the slit groove 403 of the first link 401 functions to limit a rotation range of the second link 405 in a length direction of the slit groove 403.

The locking assembly 500 may include the cancel lever 501, one end of which is rotatably coupled to one side of the first locking groove 103, and which has an extending part 503 protruding from a central part of the cancel lever to the first locking groove 103, and a pawl lever 505, one end of which is coaxially coupled to the cancel lever 501 to be rotatable, and which moves in a linked manner in accordance with the cancel lever 501.

The cancel lever 501 functions to transfer rotational force transferred through the main gear 201 and link assembly 400 to the claw 301 through the pawl lever 505.

The pawl lever 505 is coaxial with the cancel lever 501. The pawl lever 505 may press the claw 301 using force transferred by the cancel lever 501 to rotate, and then fix the claw 301 in a rotational state.

The cancel lever 501 is used for an emergency release function, which manually releases the locked state in an emergency.

Figure 4A:
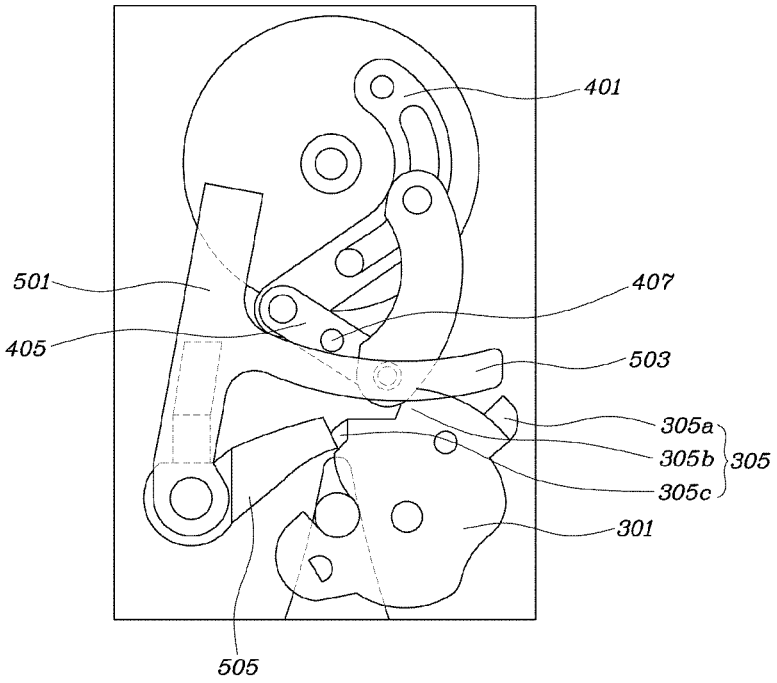
FIGS. 4A and 4B are views illustrating an operation of an emergency open function of the trunk latch module for the vehicle according to the present invention.
Figure 4B:
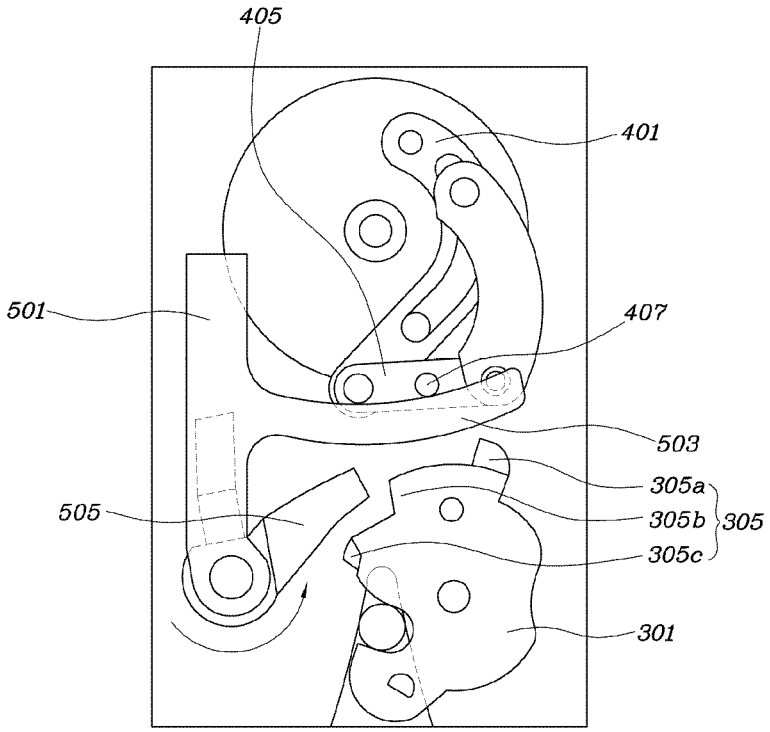

Hereinafter, details of an emergency release function will be described with reference to FIGS. 4A and 4B. Another end of the cancel lever 501 is supplied with force to rotate counterclockwise, and thus an emergency release function may be performed. The cancel lever 501 is supplied with force to rotate counterclockwise while the pawl lever 505 rotates counterclockwise, and thus the claw 301 fixed in a rotational state is released. Accordingly, the claw 301 rotates counterclockwise, and thus the claw 301 may be opened for the striker 101 to be separated.

Referring FIGS. 3A to 3C, when the main gear 201 rotates counterclockwise, the first link 401 also rotates. A hinge coupler between the first and second links 401 and 405 presses the extending part 503 downwards, and thus the cancel lever 501 rotates clockwise. The pawl lever 505 moving in linkage with the cancel lever 501 presses the first latch protrusion 305*a* of the claw 501, and thus the claw 301 rotates clockwise until the claw 301 reaches a position of a hinge coupler between the second and third links 405 and 409. The hinge coupler between the second and third links 405 and 409 presses the first protrusion 305*a*, and thus the claw 301 rotates clockwise until the pawl lever 505 engages with the second latch protrusion 305*b*. Accordingly, primary locking may be performed.

The hinge coupler between the second and third links 405 and 409 presses the first latch protrusion 305*a*, and thus the claw 301 rotates clockwise until the pawl lever 505 engages with the third latch protrusion 305*c*. Accordingly, secondary locking may be performed.

Conventionally, when locking is performed by the claw 301, an internal link structure is too complicated, and thus locking and unlocking are not properly performed because power of the motor is not properly transferred. Accordingly, a plurality of motors is provided at every rotation direction. In such a case, it is difficult to package a trunk latch module for a vehicle, and thus there are many difficulties and disadvantages in mounting the trunk latch module to the vehicle.

However, according to the present invention, both locking and unlocking of the trunk latch are performed by one motor, and thus various effects, such as low cost and increased ease of securing an advantageous mounting space for the package, are generated.

A rotational center of the claw 301 includes an elastic member, such as a torsion spring to provide counterclockwise rotational force, and thus the claw 301 is basically formed to allow the first locking groove 103 to be opened. Further, a rotational center of the cancel lever 501 includes an elastic member, such as a torsion spring, providing clockwise rotational force, and thus the pawl lever 505 moving in linkage with the cancel lever 501 always contacts an outer circumferential surface of the claw 301, thereby providing pressing force.

According to a locking mechanism provided herein, in a process of closing the trunk, when the striker 101 is inserted into the first locking groove 103, the striker 101 upwardly presses the third latch protrusion 305*c* of the claw 301 to rotate the claw 301 clockwise. In this case, since the cancel lever 501 and pawl lever 505 press the outer circumferential surface of the claw 301 by spring force, the cancel lever 501 and pawl lever 505 rotate clockwise in accordance with rotation of the claw 301, and thus the pawl lever 505 engages with a position of the second latch protrusion 305*b*. A position of the extending part 503 downwardly moves in accordance with clockwise rotation of the lever 501, and thus the hinge coupler between the second and third links 405 and 409 engages with the first latch protrusion 305*a*. As a result, primary locking is performed.

The hinge coupler between the second and third 405 and 409 continuously presses the first latch protrusion 305*a* in accordance with counterclockwise rotation of the main gear 201, and thus the claw 301 rotates clockwise. In this case, the pawl lever 505 engages with the third latch protrusion 503*c*, and thus the secondary locked state is fixed.

According to FIGS. 2A to 2C, when the main gear 201 rotates clockwise, the hinge coupler between the first and second links 401 and 405 allows the cancel lever 501 to rotate counterclockwise. The pawl 505 rotates counterclockwise in a linked manner in accordance with the cancel lever 501, and the pawl lever 505 is separated from the third latch protrusion 305*c* to be released, and thus unlocking may be performed.

Since the torsion spring disposed at the claw 301 basically provides force which allows the first locking groove 103 to be opened, the pawl lever 505 fixing the rotational state of the claw 301 is released, and thus the claw 301 is unlocked. In this case, the main gear 201 rotates clockwise, the hinge coupler between the first and second links 401 and 405 presses the cancel lever 501 to rotate counterclockwise, and the pawl lever 505 rotates counterclockwise in a linked manner in accordance with the cancel lever 501. As a result, the locked state of the claw 301 is released.

A controller may be further provided. The controller detects the primary locking through a first sensor 601 attached to the cancel lever 501, and controls second locking using counterclockwise rotation of the main gear 201 by controlling the motor operation. The controller detects completion of second locking through a second sensor 603 provided adjacent to the claw 301 on the base plate 100. The controller controls clockwise rotation of the main gear 201 through a third sensor 605 disposed on the main gear 201, and thus controls the hinge coupler between the second and third links 405 and 409 to be disposed at the second latch protrusion 305*b* of the claw 301.

Referring to FIG. 1, when the trunk is not completely closed due to insufficient force, the first to third sensors 601, 603, and 605 detect this situation and control additional motor operation to be in a secondary locked state.

As apparent from the above description, in accordance with the present invention, the trunk latch module is capable of locking and unlocking the trunk using one motor. As a result, a space occupied by the trunk latch module is reduced, and thus it is advantageous in mounting the trunk latch in the vehicle.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A trunk latch module for a vehicle, comprising:

a base plate;

a first locking groove, in which a striker is inserted, the first locking groove having a depressed shape from a lower end of the base plate toward a central part of the base plate;

a main gear disposed above the first locking groove, rotatably coupled to the base plate, and supplied with power through a motor;

a claw, a central part of which is rotatably coupled to the base plate at one side of the first locking groove, wherein one end of the claw includes a second locking groove having a depressed shape toward the central part thereof and facing an entrance position of the striker, and another end of the claw includes a latch protrusion at an outer circumferential surface thereof;

a link assembly coupled to the main gear and configured to move in linkage with rotation of the main gear, to transfer power to the claw; and a claw locking assembly supplied with power from the link assembly to fix or unfix movement of the claw, wherein as the main gear rotates in one direction by the motor, the link assembly and the claw locking assembly engage with the latch protrusion of the claw so as to lock the claw, as the main gear rotates in an opposite direction, the link assembly and the claw locking assembly are separated from the latch protrusion of the claw so as to unlock the claw, wherein the latch protrusion of the claw comprises a first latch protrusion, a second latch protrusion, and a third latch protrusion, and wherein the link assembly comprises:

a first link, a first end of which is fixed to the main gear and moves in a linked manner in accordance with the main gear, and a central part of which includes a slit groove;

a second link, a first end of which is coupled to a second end of the first link in a hinged manner, and a central part of which includes a protrusion; and a third link, a first end of which is coupled to the slit groove formed at the central part of the first link to be movable along the slit groove, and a second end of which is coupled to a second end of the second link in a hinged manner.

2. The trunk latch module according to claim 1, wherein the motor and the main gear are coupled using a worm and a worm gear to transfer power.

3. The trunk latch module according to claim 1, wherein the locking assembly comprises:

a cancel lever, one end of which is rotatably coupled to one side of the first locking groove, and which includes an extending part protruding from a central part thereof to the first locking groove; and a pawl lever, one end of which is coaxially coupled to the cancel lever to be rotatable, and which moves in a linked manner in accordance with the cancel lever.

4. The trunk latch module according to claim 3, wherein when the main gear rotates counterclockwise, the first link also rotates, the protrusion of the second link downwardly presses the extending part of the cancel lever such that the cancel lever rotates clockwise, the pawl lever moving in linkage with the cancel lever presses the first latch protrusion of the claw such that the claw rotates clockwise until the claw reaches a hinge coupler between the second and third links, the hinge coupler between the second and third links presses the first latch protrusion such that the claw rotates clockwise until the pawl lever engages with the second latch lever, so as to perform first locking.

5. The trunk latch module according to claim 4, wherein the hinge coupler between the second and third links presses the first latch protrusion such that the claw rotates clockwise until pawl lever engages with the third latch protrusion so as to perform second locking.

6. The trunk latch module according to claim 3, wherein when the main gear rotates clockwise, the cancel lever rotates counterclockwise by a hinge coupler between the first and second links, the pawl lever rotates counterclockwise in a linked manner in accordance with the cancel lever, the pawl lever is separated from the third latch protrusion to be released so as to perform unlocking.

7. The trunk latch module according to claim 5, further comprising a controller, wherein the controller detects a first locking state through a first sensor attached to the cancel lever, controls counterclockwise rotation of the main gear by controlling motor operation, detects completion of second locking through a second sensor provided adjacent to the claw on the base plate, controls clockwise rotation of the main gear through a third sensor disposed on the main gear, and controls the hinge coupler between the second and third links to be disposed at the second latch protrusion of the claw.

8. The trunk latch module according to claim 5, wherein anther end of the cancel lever is supplied with force to rotate counterclockwise so as to perform an emergency open function.

* * * * *